US005113948A

United States Patent [19]

Richardson

[11] Patent Number: 5,113,948

[45] Date of Patent: May 19, 1992

[54] OIL WELL FIRE EXTINGUISHER WITH INTERNAL PIPE CRIMPER

[76] Inventor: Randel E. Richardson, 4822 Holt Dr., Memphis, Tenn. 38116

[21] Appl. No.: 718,659

[22] Filed: Jun. 21, 1991

[51] Int. Cl.[5] ..... A62C 3/06; A62C 2/00; A62C 2/04

[52] U.S. Cl. ..... 169/49; 169/52; 169/69

[58] Field of Search ..... 169/69, 43, 47, 49, 169/52

[56] References Cited

U.S. PATENT DOCUMENTS

| | | | |
|---|---|---|---|
| 739,377 | 9/1903 | Bell | 169/69 X |
| 1,520,288 | 12/1924 | Featherstone | 169/69 X |
| 1,807,498 | 5/1931 | Teed | 169/69 X |
| 1,857,788 | 5/1932 | Murphy | 169/69 X |
| 1,859,606 | 5/1932 | Sievern et al. | 169/69 X |
| 4,323,118 | 4/1982 | Bergmann | 169/69 X |

*Primary Examiner*—Margaret A. Focarino
*Assistant Examiner*—Andrew C. Pike
*Attorney, Agent, or Firm*—Walker & McKenzie

[57] ABSTRACT

A fire extinguisher extinguishes a fire burning relative to a support surface. The fire emanates from an opened end of a pipe. The fire extingisher includes a body having a downward opening cavity for being dropped over the fire to enclose the fire within the cavity; the body has a continuous wall forming a mouth of the cavity; a seal for forming a substantially airtight seal between the continuous wall of the body and the support surface; and a crimp mechanism for crimping the opened end of the pipe after the body is dropped over the fire.

6 Claims, 3 Drawing Sheets

OIL WELL FIRE EXTINGUISHER WITH INTERNAL PIPE CRIMPER

BACKGROUND OF THE INVENTION

1. Field of the Invention

The present invention relates, in general, to means for extinguishing fires and more specifically to means for extinguishing oil well fires and the like.

2. Information Disclosure Statement

Fires are typically extinguished by spraying the fire with a fire retardant substance such as water, foam, or the like to deprive the fire of oxygen. However, with oil well fires and the like, the mere spraying of such a substance is often not sufficient to extinguish the fire.

In a typical oil well fire, hydrogen, carbon, and oxygen from the air unite to form carbon dioxide gas and water vapor. The uniting of the oxygen with the hydrogen and the carbon produces the heat and flame of the fire. Carbon monoxide gas forms when there is not enough oxygen to completely burn the fuel. Unburned carbon in the form of smoke and soot is also produced when there is not enough oxygen to completely burn the fuel. Such a typical oil well fire has an area of non combustion directly above the distal end of the oil pipe made up of gas and/or vapor that has not yet burned because it has not yet mixed sufficiently with the air and its temperature is not high enough for it to burn; an area of partial combustion directly above the area of non-combustion filled with carbon particles freed from the gas by high temperature and raised to high heat; and an area of complete combustion directly above the area of partial combustion where there is enough oxygen for complete burning.

Nothing in the prior art discloses o suggests the present invention. More specifically, nothing in the prior art discloses or suggests a fire extinguisher including, in general, body means having a downward opening cavity for being dropped over a fire burning relative to a support surface to enclose the fire within the cavity; the body means having a continuous wall forming the mouth of the cavity; and seal means for forming a substantially air-tight seal between the continuous wall of the body means and the support surface.

SUMMARY OF THE INVENTION

The present invention is directed toward providing an improved means for extinguishing oil well fires and the like. The concept of the present invention is to drop an extremely heavy enclosure over the fire to cut off the supply of oxygen to the fire and thus extinguish the fire.

The fire extinguisher of the present invention includes, in general, a body having a downward opening cavity for being dropped over a fire burning relative to a support surface to enclose the fire within the cavity; the body having a continuous wall forming the mouth of the cavity; and a seal for forming a substantially airtight seal between the continuous wall of the body and the support surface.

DESCRIPTION OF THE PREFERRED EMBODIMENT

Figure 1:
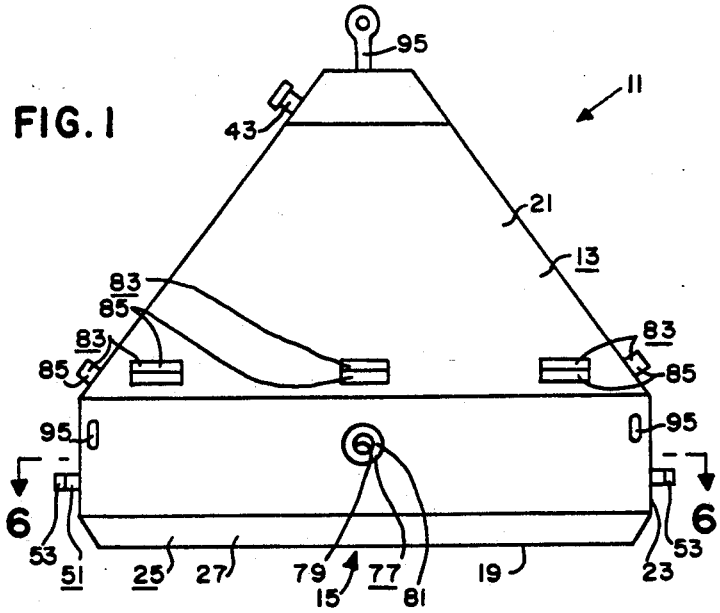
FIG. 1 is a front elevational view of a preferred embodiment of the fire extinguisher of the present invention.
Figure 2:
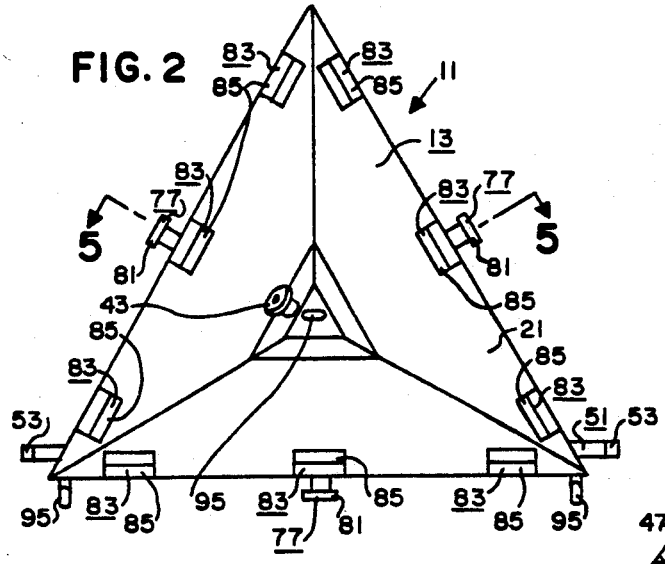
FIG. 2 is a top plan view thereof.
Figure 3:
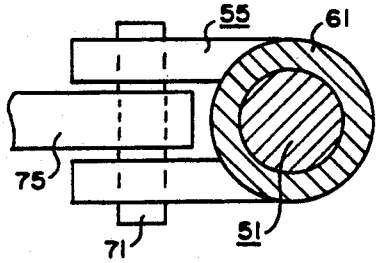
FIG. 3 is an enlarged sectional view substantially as taken on line 3—3 of FIG. 5 with portions thereof omitted for clarity.
Figure 4:
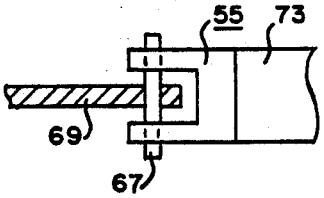
FIG. 4 is an enlarged sectional view substantially as taken on line 4—4 of FIG. 6 with portions thereof omitted for clarity.
Figure 5:
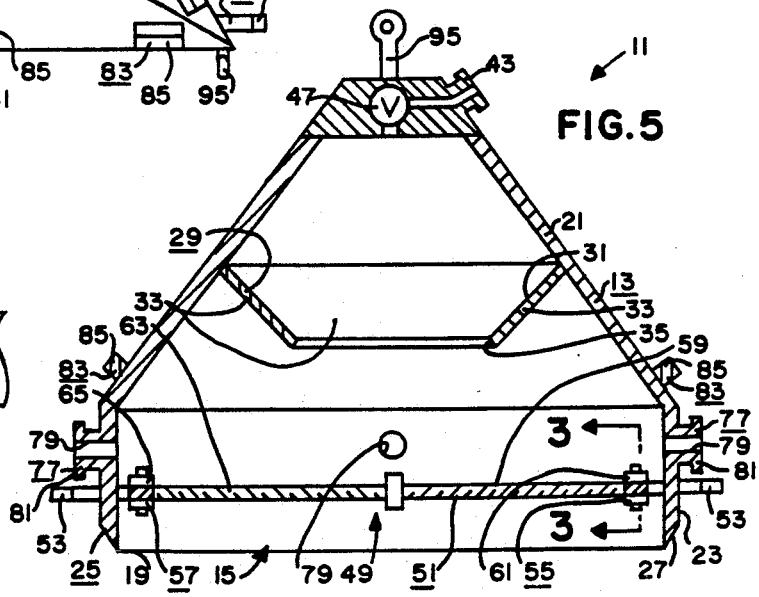
FIG. 5 is a sectional view substantially as taken on line 5—5 of FIG. 2 with portions thereof rotated for clarity.
Figure 6:
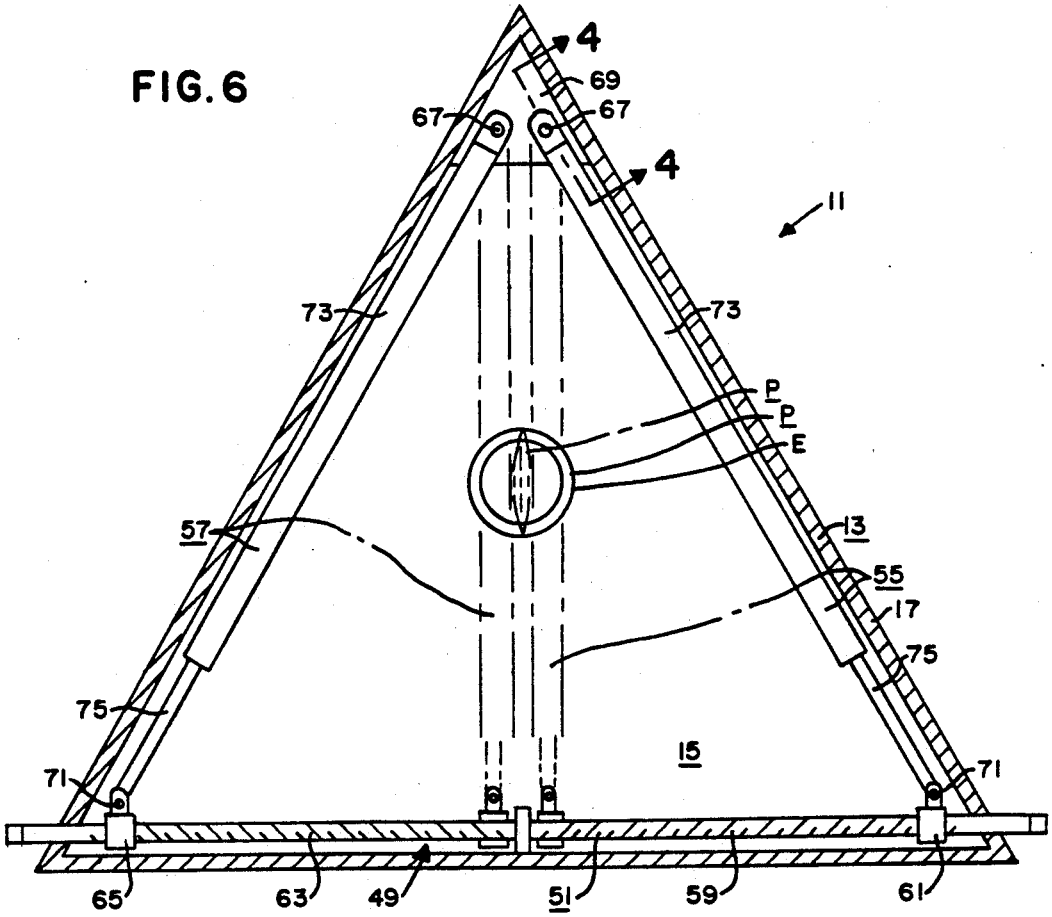
FIG. 6 is an enlarged sectional view substantially as taken on line 6—6 of FIG. 1 with the distal end of an oil well pipe, and with portions thereof shown in a moved position in broken lines for clarity.
Figure 7:
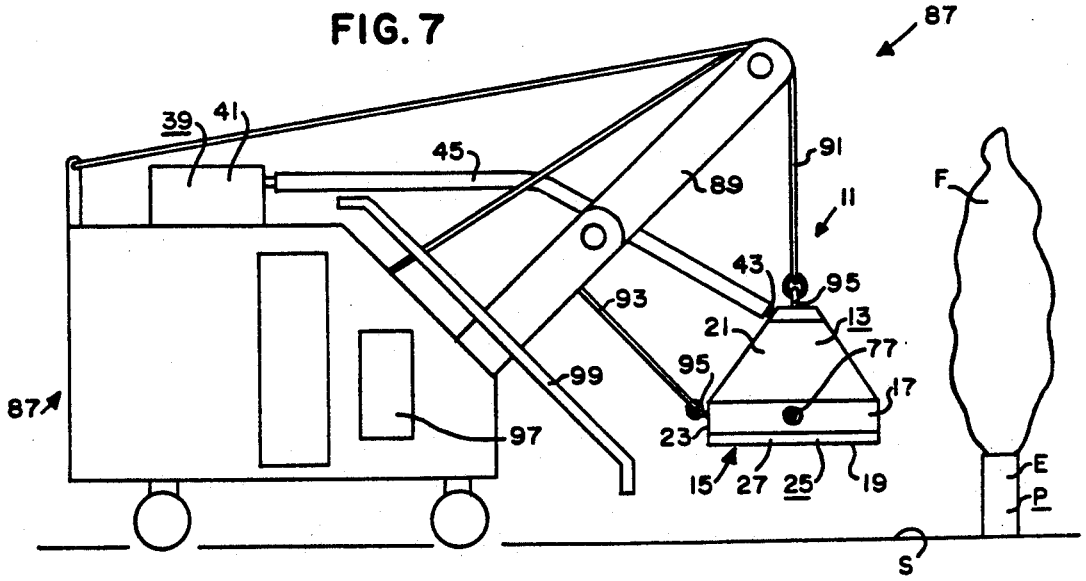
FIG. 7 is a somewhat diagrammatic view of a preferred embodiment of the fire extinguisher of the present invention with portions thereof omitted for clarity and in combination with a crane and positioned adjacent an oil well fire.

A preferred embodiment of the fire extinguisher of the present invention is shown in FIGS. 1–12 and identified by the numeral 11. The fire extinguisher 11 is used to extinguish a fire F burning on or relative to a support surface S. The fire extinguisher 11 is especially designed to extinguish fires F that emanate from the opened end E of an oil well pipe P or the like.

The fire extinguisher 11 includes body means 13 having a downward opening cavity 15 for being dropped over the fire F to enclose the fire F within the cavity 15. The body means 13 has a continuous wall 17, the lower end of which forms the mouth 19 of the cavity 15. The body means 13 may be constructed in any manner and out of any material that will form a strong, rigid, heavy, fire resistant structure with a downward opening cavity. The body means 13 is preferably constructed out of a plurality of strong, rigid metal plates having a thickness of approximately 25.4 millimeters (1 inch) and welded together to form a strong, rigid, heavy, fire resistant structure having a three-sided, pyramid like upper portion 21 and three-side, vertical wall lower portion 23 with the lower edge of the lower portion 23 forming the lip of the mouth 19 as will now be apparent to those skilled in the art.

The fire extinguisher 11 includes seal means 25 for forming a substantially airtight seal between the continuous wall 17 of the body means 13 and the support surface S. The seal means 25 preferably includes a continuous cutting blade means 27 on the lower edge of the continuous wall 17 of the body means 13 for cutting into the support surface S when the body means 13 is dropped over the fire F. The seal means 25 may be constructed in various manners as will now be apparent to those skilled in the art. Preferably, the cutting blade means 27 is merely cut, ground, or otherwise machined into the lower edge of the continuous wall 17 of the body means 13 so that the lower edge of the continuous wall 17 will easily dig or cut into the support surface S when the body means 13 is dropped onto the support surface S from a substantial height above the support surface S as will now be apparent to those skilled in the art.

The fire F typically causes heavier-than-air particles 28 to rise upward therefrom in the form of suspended carbon particles and the like in the smoke rising from the fire F as will now be apparent to those skilled in the art. The fire extinguisher 11 preferably includes deflector means 29 for directing the heavier than-air particles 28 back onto the fire F (see FIG. 12). The deflector means 29 preferably includes means positioned within the cavity 15 and mounted to the wall of the body means 13 having a downward and inward directed upper surface 31 for directing any such heavier-than-air particles 2 that fall from the smoke toward the center of the cavity 15. The deflector means 29 may be constructed in any manner and out of any material that will form a strong, rigid, fire resistant structure. Preferably, the deflector means 29 includes a plurality of downward and inward angled metal plates 33 welded or otherwise fixedly attached to the body means 13 within the cavity 15 in such a manner so that the lower edges of each plate 33 coact to define a central aperture 35 substantially at the longitudinal center of the cavity 15 and for directing any such heavier-than-air particles 28 that fall from the smoke toward the center of the cavity 15 a will now be apparent to those skilled in the art.

Figure 12:
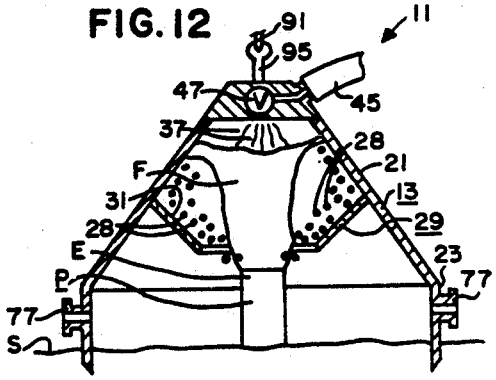
FIG. 12 is a somewhat diagrammatic sectional view similar to FIG. 5, but showing the fire extinguisher of the present invention enclosing an oil well fire.

The fire extinguisher 11 preferably includes a fire retardant substance 37 for being applied to the fire F after the body means 13 has been dropped over the fire F (see FIG. 12). More specifically, the fire extinguisher 11 preferably includes a pressurized fire retardant source 39 for providing a pressurized supply of the fire retardant substance 37. The pressurized fire retardant source 39 preferably includes a typical pressurized tank 41 of a fire retardant foam or the like as will now be apparent to those skilled in the art. The fire extinguisher 11 preferably includes an inlet port means 43 on the body means 13 for allowing the fire retardant substance 37 to enter the cavity 15, and conduit means 45 extending from the tank 41 to the inlet port mean 43 for allowing the fire retardant substance 37 to pass from the pressurized fire retardant source 39 into the cavity 15 of the body means 13. The inlet port means 43 preferably includes a check valve means 47 for allowing the fire retardant substance 37 to pass into the cavity 15 of the body means 13 through the conduit means 45 while preventing anything from passing from the cavity 15 of the body means 13 out the inlet port means 43 into the pressurized fire retardant source 39, etc. Control means such as a valve and the like is preferably provided for allowing an operator to control the passage of the fire retardant substance 37 from the tank 41 through the conduit means 45, to the inlet port 43 as will now be apparent to those skilled in the art.

The fire extinguisher 11 preferably includes crimp means 49 for crimping the opened end E of the pipe P after the body means 13 is dropped over the fire F. The crimp means 49 preferably includes an elongated rod member 51 rotatably attached to the body means 13 and extending across the cavity 15 of the body means 13. The rod member 51 has a drive portion 53 accessible from the exterior of the body means 13 for allowing the rod member 51 to be rotated. The drive portion 53 may consist merely of flats or the like machined or otherwise formed on each end of the rod member 51 to allow a wrench or other tool to securely grip and rotate the rod member 51. The crimp means 49 preferably includes a first clamp member 55 attached to the rod member 51 for being moved between an opened position as shown in solid lines in FIG. 6 and a closed position as shown in broken lines in FIG. 6 when the rod member 51 is rotated. The crimp means 49 preferably includes a second clamp member 57 attached to the rod member 51 for being moved between an opened position as shown in solid lines in FIG. 6 and a closed position as shown in broken lines in FIG. 6 when the rod member 51 is rotated. The first and second clamp members 55, 57 coact to crimp the opened end E of the pipe P closed when the rod member 51 is rotated to cause the first and second clamp members 55, 57 to move to the closed positions after the body means 13 is dropped over the fire F. The rod member 51 preferably has right hand threads 59 on the first end thereof for coacting with a threaded follower member 61 attached to one end of the first clamp member 55 so that the first clamp member 55 will move back and forth on the rod member 51 between the opened and closed positions when the rod member 51 is rotated as will now be apparent to those skilled in the art. The rod member 51 preferably has left hand threads 63 on the second end thereof for coacting with a threaded follower member 65 attached to one end of the second clamp member 57 so that the second claim member 57 will move back and forth between the opened and closed positions when the rod member 51 is rotated as will now be apparent to those skilled in the art. The opposite ends of the first and second clamp members 55, 57 are preferably pivotally attached to the body means 13 by pins 67 extending through a plate 69 that is fixedly attached by welding or the like to the body means 13 as clearly shown in FIGS. 4 and 6, and to the respective threaded follower members 61, 65 by pins 71 extending through coacting ears or the like on the ends of each clamp member 55, 57 and the respective threaded follower member 61, 65 as clearly shown in FIGS. 3 and 6, and as will now be apparent to those skilled in the art. Each clamp member 55, 57 is preferably telescopic for easy movement back and forth on the rod member 51 as the rod member 51 is rotated. Thus, one end of each clamp member 55, 57 may include a sleeve portion 73 and the other end of each clamp member 55, 57 may include a rod portion 75 slidably mounted within the respective sleeve portion 73 so that each clamp member 55, 57 can telescope from a longer overall length to a shorter overall length when the clamp members 55, 57 are moved from the opened position to the closed position, and vice versa, as will now be apparent to those skilled in the art. The rod member 51 and clamp members 55, 57 may be machined or otherwise constructed out of metal or the like to form a strong, heat resistant unit.

The fire extinguisher 11 preferably includes a plurality of outlet port means 77 communicating with the cavity 15 of the body means 13 for allowing fluid such as oil to pass from the cavity 15 of the body means 13. Each outlet port means 77 preferably includes an aperture 79 extending through the wall 17 of the body means 13, and a quick connect means 81 surrounding the aperture 79 on the exterior of the wall 17 for allowing a hose or the like (not shown) to be quickly coupled thereto to allow fluid to be carried through the hose away from the oil well pipe P, etc., as will now be apparent to those skilled in the art. The outlet port means 77 ar preferably arranged substantially equal about the lower portion 23 of the body means 13.

The fire extinguisher 11 preferably includes a plurality of weight means 83 for increasing the weight of the body means 13 and for increasing the effectiveness of the seal between the continuous wall 17 of the body means 13 and the support surface S. Each weight means 83 preferably consists of a weight member 85 constructed of lead or the like for being removably attached to the exterior of the wall 17 of the body means 13 by bolts or the like (not shown). The weight members 85 are preferably attached substantially equal about the lower edge of the upper portion 21 of the body means 13.

The fire extinguisher 11 is preferably used in combination with a typical crane 87 or the like for picking up the body means 13, carrying or moving the body means 13 to a location substantially directly over the fire F, and then dropping the body means 13 over the fire F. The crane 87 preferably includes a boom or jib 89, a hoisting rope 91, and one or more tag lines 93. The body means 13 preferably includes a plurality of eyelets 95 or the like for allowing the hoisting rope 91 and tag lines 93 to be secured thereto. The eyelets 95 are preferably constructed out of metal and securely welded to the body means 13. The crane 87 preferably has a cab 97 for housing a driver. A heat shield means 99 is preferably included for being positioned between the body means 13 and the cab 97 of the crane 87 for shielding the driver of the crane 87 from the fire F as the body means 13 is moved to and dropped over the fire F. The heat shield 99 preferably includes a heat resistant window 101 (see FIGS. 10 and 11) for allowing the driver of the crane 87 to see therethrough. Apertures 103 are preferably provided in the heat shield 99 (see FIGS. 10 and 11) for allowing the jib 89 and various lines to extend therethrough.

Figure 8:
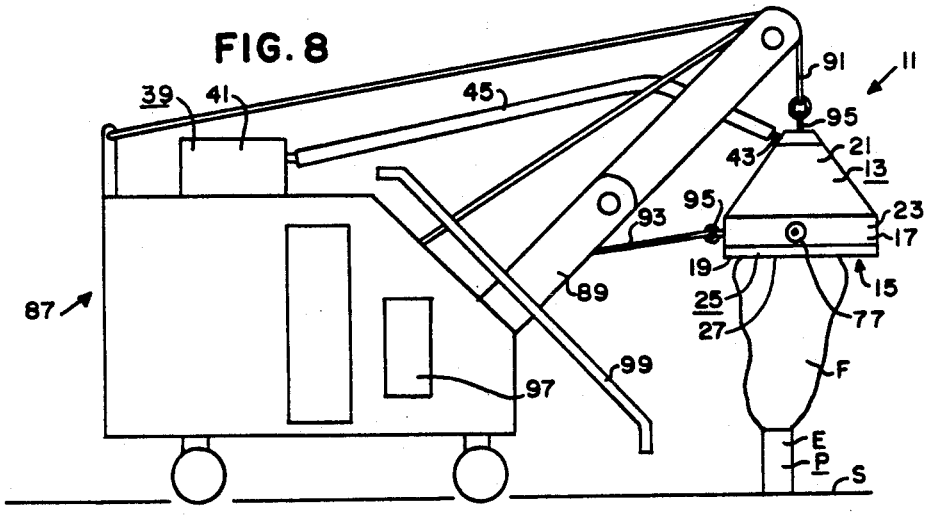
FIG. 8 is a somewhat diagrammatic view of a preferred embodiment of the fire extinguisher of the present invention similar to FIG. 7, but with the fire extinguisher positioned directly over the oil well fire.
Figure 9:
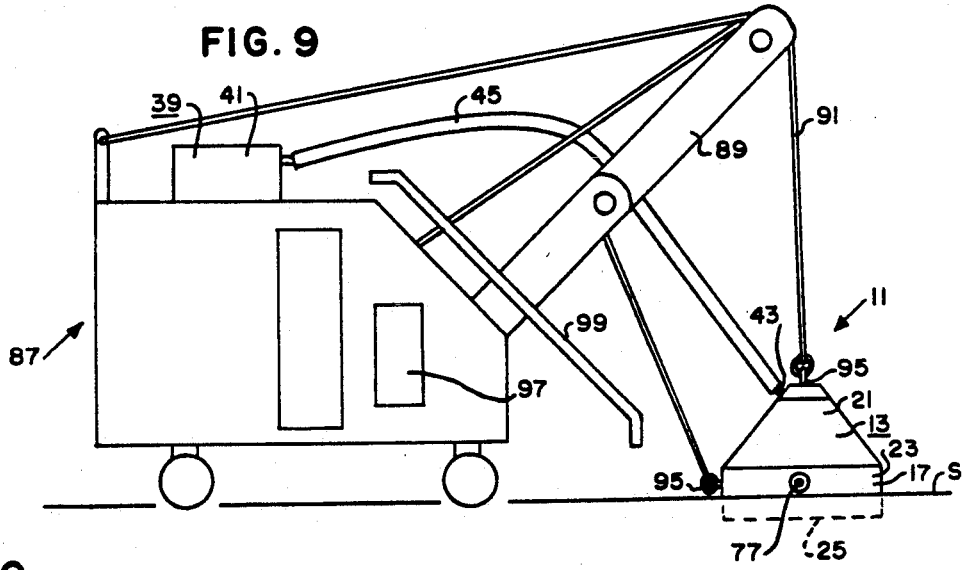
FIG. 9 is a somewhat diagrammatic view of a preferred embodiment of the fire extinguisher of the present invention similar to FIGS. 7 and 8, but with the fire extinguisher shown enclosing the oil well fire.
Figure 10:
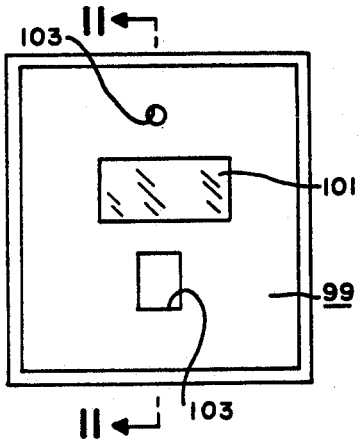
FIG. 10 is a front elevational view of a heat shield means for use in combination with the fire extinguisher of the present invention.
Figure 11:
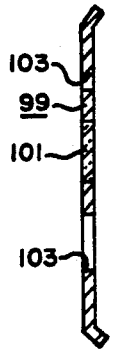
FIG. 11 is a sectional view as taken on line 11—11 of FIG. 10.

The use and operation of the fire extinguisher 11 is quite simple. In the event of an oil well fire F or the like, the body means 13 can be easily and quickly constructed out of standard metal plates and the like. Depending on the intensity of the fire F, etc., weight means 83 may be added to the body means 13 to increase the weight thereof. The crane 87 can then be used to pick up and move the body means 13 to a position substantially directly over the fire F as shown in FIG. 8. Next, the driver of the crane 87 drops the body means 13 over the fire F whereby the weight of the body means 13 causes the cutting blade means 27 to cut into the support surface S and form a substantially airtight seal therebetween. This will reduce the oxygen available to the fire F and may be sufficient to extinguish the fire F. However, if desired or needed, the fire retardant substance 37 may be applied to the fire F within the cavity 15 of the body means 13.

Although the present invention has been described and illustrated with respect to a preferred embodiment and a preferred use therefor, it is not to be so limited since modifications and changes can be made therein which are within the full intended scope of the invention.

I claim:

1. A fire extinguisher for use to extinguish a fire burning relative to a support surface, said fire emanating from an opened end of a pipe, said fire extinguisher comprising:

a. body means having a downward opening cavity for being dropped over said first to enclose said first within said cavity, said body means having a continuous wall forming a mouth of said cavity;

b. seal means for forming a substantially airtight seal between said continuous wall of said body means and said support surface; and c. crimp means for crimping said opened end of said pipe after said body means is dropped over said fire.

2. The fire extinguisher of claim 1 in which said crimp means includes an elongated rod member rotatably attached to said body means and extending across said cavity of said body means, said rod member having a drive portion accessible from an exterior of said body means for allowing said rod member to be rotated; said crimp means further includes a first clamp member attached to said rod member for being moved between an opened position and a closed position when said rod member is rotated; and said crimp means further includes a second clamp member attached to said rod member for being moved between an opened position and a closed position when said rod member is rotated; said first and second clamp members crimping said opened end of said pipe closed when said rod member is rotated to cause said first and second clamp members to move to said closed positions after said body means is dropped over said fire.

3. A fire extinguisher for use to extinguish a fire burning relative to a support surface, said fire causing heavier-than-air particles to rise upward from said fire, said fire emanating from an opened end of a pipe, said fire extinguisher comprising:

a. body means having a downward opening cavity for being dropped over said fire to enclose said fire within said cavity, said body means having a continuous wall forming a mouth of said cavity;

b. seal means for forming a substantially airtight seal between said continuous wall of said body means and said support surface, said seal means including a continuous cutting blade means extending downward from said continuous wall of said body means for cutting into said support surface when said body means is dropped over said fire;

c. a fire retardant substance for being applied to said fire after said body means has been dropped over said fire;

d. deflector means for directing said heavier-than-air particles back onto said fire; and e. crimp means for crimping said opened end of said pipe after said body means is dropped over said fire.

4. The fire extinguisher of claim 3 in which is further included a pressurized fire retardant source for providing a pressurized supply of said fire retardant substance; conduit means for allowing said fire retardant substance to pass from said pressurized fire retardant source into said cavity of said body means; and check valve means for allowing said fire retardant substance to pass into said cavity of said body means through said conduit means while preventing anything from passing from said cavity of said body means into said pressurized fire retardant source; wherein said crimp means includes an elongated rod member rotatably attached to said body means and extending across said cavity of said body means, said rod member having a drive portion accessible from an exterior of said body means for allowing said rod member to be rotated; said crimp means includes a first clamp member attached to said rod member for being moved between an opened position and a closed position when said rod member is rotated; and said crimp means includes a second clamp member attached to said rod member for being moved between an opened portioned and a closed position when said rod member is rotated; said first and second clamp members crimping said opened end of said pipe closed when said rod member is rotated to cause said first and second clamp members to move to said closed positions after said body means is dropped over said fire.

5. The fire extinguisher of claim 4 in which is further included a plurality of outlet port means communicating with said cavity of said body means for allowing fluid to pass from said cavity of said body means.

6. The fire extinguisher of claim 5 in which is further included a plurality of weight means for adding weight to said body means and for increasing the effectiveness of said seal between said continuous wall of said body means and said support surface.

* * * * *